US010653177B2

(12) United States Patent
Feldman et al.

(10) Patent No.: US 10,653,177 B2
(45) Date of Patent: May 19, 2020

(54) CARTOMIZER STRUCTURE FOR AUTOMATED ASSEMBLY

(71) Applicant: Nu Mark Innovations Ltd., Beit Shemesh (IL)

(72) Inventors: Zvika Feldman, Tsoran (IL); Arie Holtz, Jerusalem (IL); Eyal Peleg, Tsoran (IL); Sammy Capuano, Ramat Bet Shemesh (IL)

(73) Assignee: NU MARK INNOVATIONS LTD, Beit Shemesh (IL)

( * ) Notice: Subject to any disclaimer, the term of this patent is extended or adjusted under 35 U.S.C. 154(b) by 253 days.

(21) Appl. No.: 15/840,289

(22) Filed: Dec. 13, 2017

(65) Prior Publication Data

US 2018/0098579 A1 Apr. 12, 2018

Related U.S. Application Data

(62) Division of application No. 14/335,436, filed on Jul. 18, 2014, now Pat. No. 9,848,645.

(Continued)

(51) Int. Cl.

*A24F 40/70* (2020.01)
*A24F 47/00* (2020.01)

(Continued)

(52) U.S. Cl.

CPC ..... *A24F 40/70* (2020.01); *A24F 47/008* (2013.01); *H01R 9/00* (2013.01); *H05B 3/06* (2013.01);

(Continued)

(58) Field of Classification Search

CPC ..... A24F 47/008; A24F 40/70; H01R 9/00; Y10T 29/49117; Y10T 29/49002; H05B 3/16; H05B 3/06

See application file for complete search history.

(56) References Cited

U.S. PATENT DOCUMENTS 1,775,947 A 9/1930 Robinson
1,968,509 A 7/1934 Tiffany (Continued)

FOREIGN PATENT DOCUMENTS

CH 421786 A 9/1966
CN 87104459 A 2/1988

(Continued)

OTHER PUBLICATIONS

Daniel Stephen, E cig Cartomizers Filling and Assembly, Mar. 22, 2017 [viewed online Jan. 20, 2020], https://www.youtube.com/watch?v=VHthFXSQHZU. (Year: 2017).*

(Continued)

*Primary Examiner* — Anthony Calandra

(74) *Attorney, Agent, or Firm* — Harness, Dickey & Pierce, P.L.C.

(57) ABSTRACT

A cartomizer assembly of an electronic cigarette which is formed from automated assembly compatible parts comprises a container assembly including a container and a heater coil surrounding a wick in an airflow space of the container. The entire coil of the heater coil is inside the container and the heater coil is configured to heat liquid on the wick to generate an aerosol mist during a vaporization process. A liquid storage space is in liquid communication with the wick and is operable to supply liquid to the wick. The heater, the wick, and the container are shaped such that the heater and wick can be dropped into the container during automated assembly thereof and be directed to and located at a desired location in the container.

4 Claims, 17 Drawing Sheets

Related U.S. Application Data

(60) Provisional application No. 61/857,956, filed on Jul. 24, 2013.

(51) Int. Cl.
*H05B 3/06* (2006.01)
*H05B 3/16* (2006.01)
*H01R 9/00* (2006.01)

(52) U.S. Cl.
CPC ..... *H05B 3/16* (2013.01); *Y10T 29/49002* (2015.01); *Y10T 29/49117* (2015.01)

(56) References Cited

U.S. PATENT DOCUMENTS

| | | | | |
|---|---|---|---|---|
| 2,057,353 | A | 10/1936 | Whittmore, Jr. | |
| 3,402,723 | A | 9/1968 | Hu | |
| 3,425,414 | A | 2/1969 | La Roche | |
| 4,141,369 | A | 2/1979 | Burruss | |
| 4,164,230 | A | 8/1979 | Pearlman | |
| 4,735,217 | A | 4/1988 | Gerth et al. | |
| 4,922,901 | A | 5/1990 | Brooks et al. | |
| 4,947,874 | A | 8/1990 | Brooks et al. | |
| 4,947,875 | A | 8/1990 | Brooks et al. | |
| 5,036,583 | A * | 8/1991 | Prochaska | H01R 13/187 29/874 |
| 5,060,671 | A | 10/1991 | Counts et al. | |
| 5,144,962 | A | 9/1992 | Counts et al. | |
| 5,269,327 | A | 12/1993 | Counts et al. | |
| 5,498,855 | A | 3/1996 | Deevi et al. | |
| 5,505,214 | A | 4/1996 | Collins et al. | |
| 5,613,504 | A | 3/1997 | Collins et al. | |
| 5,666,977 | A | 9/1997 | Higgins et al. | |
| 5,666,978 | A | 9/1997 | Counts et al. | |
| 5,865,185 | A | 2/1999 | Collins et al. | |
| 6,155,268 | A | 12/2000 | Takeuchi | |
| 6,196,218 | B1 | 3/2001 | Voges | |
| 6,443,146 | B1 | 9/2002 | Voges | |
| 6,532,965 | B1 | 3/2003 | Abhulimen et al. | |
| 6,598,607 | B2 | 7/2003 | Adiga et al. | |
| 6,772,756 | B2 | 8/2004 | Shayan | |
| 7,117,867 | B2 | 10/2006 | Cox et al. | |
| 7,131,599 | B2 | 11/2006 | Katase | |
| 7,458,374 | B2 | 12/2008 | Hale et al. | |
| 7,726,320 | B2 | 6/2010 | Robinson et al. | |
| 7,832,410 | B2 | 11/2010 | Hon | |
| 8,079,371 | B2 | 12/2011 | Robinson et al. | |
| 8,156,944 | B2 | 4/2012 | Han | |
| 8,205,622 | B2 | 6/2012 | Pan | |
| 8,365,742 | B2 | 2/2013 | Hon | |
| 8,371,310 | B2 | 2/2013 | Brenneise | |
| 8,375,957 | B2 | 2/2013 | Hon | |
| 8,393,331 | B2 | 3/2013 | Hon | |
| 8,511,318 | B2 | 8/2013 | Hon | |
| 8,528,569 | B1 | 9/2013 | Newton | |
| 8,550,068 | B2 | 10/2013 | Terry et al. | |
| 8,550,069 | B2 | 10/2013 | Alelov | |
| 8,689,805 | B2 | 4/2014 | Hon | |
| 2004/0020500 | A1 | 2/2004 | Wrenn et al. | |
| 2004/0200493 | A1 | 10/2004 | Matsufuji et al. | |
| 2005/0016549 | A1 | 1/2005 | Banerjee et al. | |
| 2007/0267031 | A1 | 11/2007 | Hon | |
| 2009/0095311 | A1 | 4/2009 | Han | |
| 2009/0126745 | A1 | 5/2009 | Hon | |
| 2009/0151717 | A1 | 6/2009 | Bowen et al. | |
| 2009/0188490 | A1 | 7/2009 | Han | |
| 2009/0230117 | A1 | 9/2009 | Fernando et al. | |
| 2009/0272379 | A1 | 11/2009 | Thorens et al. | |
| 2010/0031968 | A1 | 2/2010 | Sheikh et al. | |
| 2011/0005535 | A1 | 1/2011 | Xiu | |
| 2011/0011396 | A1 | 1/2011 | Fang | |
| 2011/0036346 | A1 | 2/2011 | Cohen et al. | |
| 2011/0147486 | A1 | 6/2011 | Greim et al. | |
| 2011/0209717 | A1 | 9/2011 | Han | |
| 2011/0226236 | A1 | 9/2011 | Buchberger | |
| 2011/0232654 | A1 | 9/2011 | Mass | |
| 2011/0265806 | A1 | 11/2011 | Alarcon et al. | |
| 2011/0277756 | A1 | 11/2011 | Terry et al. | |
| 2011/0277757 | A1 | 11/2011 | Terry et al. | |
| 2011/0277760 | A1 | 11/2011 | Terry et al. | |
| 2011/0277761 | A1 | 11/2011 | Terry et al. | |
| 2011/0277764 | A1 | 11/2011 | Terry et al. | |
| 2011/0277780 | A1 | 11/2011 | Terry et al. | |
| 2011/0303231 | A1 | 12/2011 | Li et al. | |
| 2012/0111347 | A1 | 5/2012 | Hon | |
| 2012/0174914 | A1 | 7/2012 | Pirshafiey et al. | |
| 2012/0199663 | A1 | 8/2012 | Qiu | |
| 2012/0260927 | A1 | 10/2012 | Liu | |
| 2012/0285475 | A1 | 11/2012 | Liu | |
| 2012/0312313 | A1 | 12/2012 | Frija | |
| 2012/0318882 | A1 | 12/2012 | Abehasera | |
| 2013/0014772 | A1 | 1/2013 | Liu | |
| 2013/0037041 | A1 | 2/2013 | Worm et al. | |
| 2013/0042865 | A1 | 2/2013 | Monsees et al. | |
| 2013/0056013 | A1 | 3/2013 | Terry et al. | |
| 2013/0180533 | A1 | 7/2013 | Kim et al. | |
| 2013/0192616 | A1 | 8/2013 | Tucker et al. | |
| 2013/0192619 | A1 | 8/2013 | Tucker et al. | |
| 2013/0192620 | A1 | 8/2013 | Tucker et al. | |
| 2013/0192621 | A1 | 8/2013 | Li et al. | |
| 2013/0192622 | A1 | 8/2013 | Tucker et al. | |
| 2013/0192623 | A1 | 8/2013 | Tucker et al. | |
| 2013/0213419 | A1 | 8/2013 | Tucker et al. | |
| 2013/0220315 | A1 | 8/2013 | Conley et al. | |
| 2013/0284192 | A1 | 10/2013 | Peleg et al. | |
| 2013/0298905 | A1 | 11/2013 | Levin et al. | |
| 2013/0319407 | A1 | 12/2013 | Liu | |
| 2014/0034071 | A1 * | 2/2014 | Levitz | A24F 47/008 131/329 |
| 2014/0109898 | A1 | 4/2014 | Li et al. | |
| 2014/0144453 | A1 | 5/2014 | Capuano et al. | |
| 2014/0261408 | A1 | 9/2014 | DePiano et al. | |
| 2015/0101626 | A1 | 4/2015 | Li et al. | |

FOREIGN PATENT DOCUMENTS

| | | | |
|---|---|---|---|
| CN | 2719043 | Y | 8/2005 |
| CN | 2777995 | Y | 5/2006 |
| CN | 101116542 | A | 2/2008 |
| CN | 201018927 | Y | 2/2008 |
| CN | 201029436 | Y | 3/2008 |
| CN | 201054977 | Y | 5/2008 |
| CN | 201067079 | Y | 6/2008 |
| CN | 201076006 | Y | 6/2008 |
| CN | 201085044 | Y | 7/2008 |
| CN | 101518361 | A | 9/2009 |
| CN | 201379072 | Y | 1/2010 |
| CN | 201709398 | U | 1/2011 |
| CN | 201789924 | U | 4/2011 |
| CN | 201797997 | U | 4/2011 |
| CN | 102106611 | A | 6/2011 |
| CN | 201860753 | U | 6/2011 |
| CN | 202014572 | U | 10/2011 |
| CN | 202026804 | U | 11/2011 |
| CN | 202233005 | U | 5/2012 |
| CN | 202233007 | U | 5/2012 |
| CN | 203015837 | | 6/2013 |
| CN | 203040683 | | 7/2013 |
| CN | 203058296 | | 7/2013 |
| CN | 203058297 | U | 7/2013 |
| CN | 203058299 | | 7/2013 |
| DE | 19854009 | A1 | 5/2000 |
| EP | 0893071 | A1 | 7/1908 |
| EP | 0358002 | A2 | 3/1990 |
| EP | 0358114 | A2 | 3/1990 |
| EP | 0430566 | A2 | 6/1991 |
| EP | 0845220 | A1 | 6/1998 |
| EP | 2022350 | A1 | 2/2009 |
| EP | 2113178 | A1 | 11/2009 |
| EP | 2481308 | A1 | 8/2012 |
| EP | 2614732 | A1 | 7/2013 |
| EP | 2762019 | A1 | 8/2014 |
| JP | 2006320286 | A | 11/2006 |
| WO | WO-2004/080216 | A1 | 9/2004 |

(56) References Cited

FOREIGN PATENT DOCUMENTS

| | | | |
|---|---|---|---|
| WO | WO-2004/095955 | A1 | 11/2004 |
| WO | WO-2005/053444 | A1 | 6/2005 |
| WO | WO-2007/078273 | A1 | 7/2007 |
| WO | WO-2007/131449 | A1 | 11/2007 |
| WO | WO-2007/131450 | A1 | 11/2007 |
| WO | WO-2008/055423 | A1 | 5/2008 |
| WO | WO-2010/091593 | A1 | 8/2010 |
| WO | WO-2010/145468 | A1 | 12/2010 |
| WO | WO-2011/124033 | A1 | 10/2011 |
| WO | WO-2011/125058 | A1 | 10/2011 |
| WO | WO-2011/146372 | A2 | 11/2011 |
| WO | WO-2012/129787 | A1 | 10/2012 |

OTHER PUBLICATIONS

International Search Report and Written Opinion dated Feb. 27, 2015.
Eurasian Office Action dated Jan. 30, 2018 issued in Eurasian Patent Application No. 201690261.
First Office Action dated Feb. 1, 2018 issued in Chinese Patent Application No. 201480052186.3.

* cited by examiner

CARTOMIZER STRUCTURE FOR AUTOMATED ASSEMBLY

CROSS REFERENCE TO RELATED APPLICATION

This application is a divisional of U.S. application Ser. No. 14/335,436, filed on Jul. 18, 2014, which claims priority under 35 U.S.C. § 119(e) to U.S. Provisional Application No. 61/857,956, filed on Jul. 24, 2013, the entire content of each of which are incorporated herein by reference thereto.

BACKGROUND

An electronic cigarette ("e-cigarette" or "e-Cig") is a device that emulates tobacco cigarette smoking by producing smoke replacement that may be similar to tobacco cigarette smoke in its physical sensation, general appearance, and sometimes flavor (i.e., with tobacco fragrance, menthol taste, added nicotine etc.). A battery portion of the e-Cig includes a controller and battery for powering the device and a cartomizer portion (i.e. cartomizer assembly) which generates an aerosol mist (i.e. vapor) that is a replacement for cigarette smoke. The cartomizer may use heat, ultrasonic energy, or other means to atomize/vaporize a liquid solution (for example based on propylene glycol, or glycerin, for example including taste and fragrance ingredients) into an aerosol mist. The liquid solution may be similar to nebulizer or humidifier vaporizing solutions for inhalation. The component in the cartomizer that generates the mist (as used herein aerosol generating component) is sometimes referred to as the cartomizer itself. The cartomizer typically includes a space (as used herein "liquid storage space") that contains the required fluid or liquid (e.g. e-Liquid) used for generating the mist and another space (as used herein "airflow space") for airflow. The e-Liquid can be absorbed or held in a sponge which is disposed in the storage space. Transferring the e-Liquid from its storage space to the airflow space wherein the e-Liquid is subsequently heated can cause the density of the e-Liquid to decrease, and these factors together with the air flow triggered by the inhalation of a user provide challenges in automation of the cartomizer assembly.

In order to create the storage space, the airflow space, and a separation therebetween, the cartomizer can include flexible parts, self-disintegrating parts, and uneven parts. These characteristics may become accentuated at the components' extremities such as the extremities of a wick, or a coil, etc., which may hinder and even altogether preclude the possibility for an automated assembly process of forming the cartomizer. Even in the presence of machines that produce subassemblies of several components together, the general assembly process of the cartomizer may be based on human intervention that can deal with the various characteristics of the components thereof.

SUMMARY

Disclosed herein is a cartomizer assembly of an electronic cigarette which is configured to connect with a battery portion of the electronic cigarette wherein the cartomizer assembly is formed from automated assembly compatible parts. The cartomizer assembly comprises a container assembly including a container and a heater coil surrounding a wick in an airflow space of the container wherein the entire coil of the heater coil is inside the container. The heater coil is configured to heat liquid on the wick to generate an aerosol mist during a vaporization process. A liquid storage space is in liquid communication with the wick and is operable to supply liquid to the wick. The heater, the wick, and the container are shaped such that the heater and wick can be dropped into the container during automated assembly thereof and be directed to and located at a desired location in the container.

Also disclosed herein is a method of assembling a container assembly of a cartomizer assembly of an electronic cigarette wherein the container assembly is formed from automated assembly compatible parts. The method comprises winding a heater coil around a wick, dropping the heater coil and wick into a container, and locating heater coil leads of the heater coil in location notches of the container. The heater, the wick, and the container are each shaped such that the heater and wick can be dropped into the container during automated assembly thereof and be directed to and located at a desired location in the container.

Further disclosed herein is a method of assembling a cartomizer assembly of an electronic cigarette wherein the cartomizer assembly is formed from automated assembly compatible parts. The method comprises inserting an inner post into an outer post wherein a conductive strip is disposed therebetween, and inserting a punch into a hole in the inner post wherein the punch removes a portion of the conductive strip so as to form conductors.

BRIEF DESCRIPTION OF THE DRAWINGS

Non-limiting and non-exhaustive embodiments are described with reference to the following drawings. The components in the drawings are not necessarily to scale, emphasis instead being placed upon illustrating the principles of embodiments as disclosed herein. In the drawings, like referenced numerals designate corresponding parts throughout the different views.

DETAILED DESCRIPTION

Figure 1:
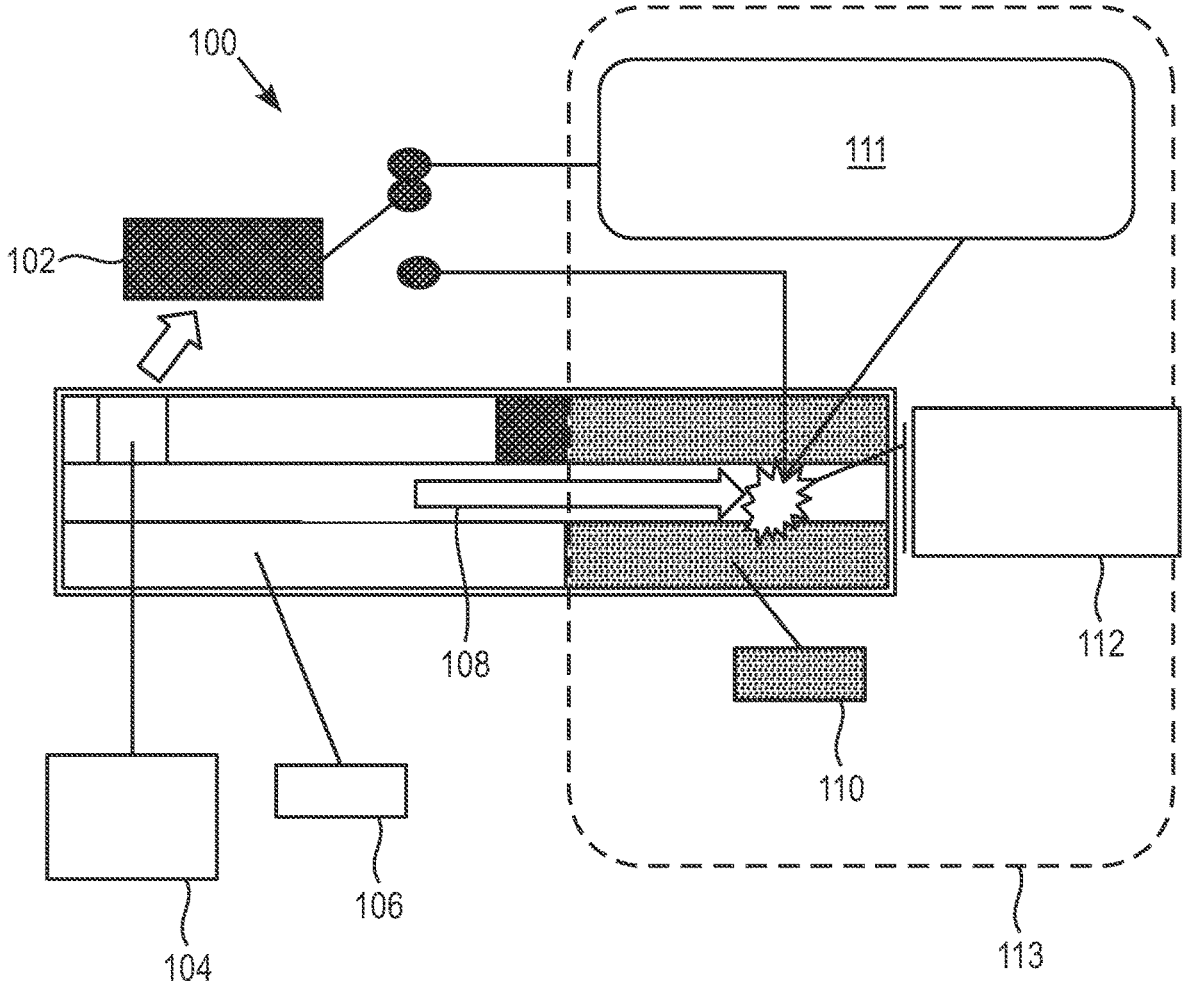
FIG. 1 is a diagram of an electronic cigarette.

By way of introduction, a system and method may improve the structure of and assembly process for a cartomizer of an e-Cig. The improved cartomizer isolates certain components with features that can cause manufacturing difficulties and confines them as a sub-assembly (e.g. a wick and a heater coil into a wick-coil assembly) in a confining process. The sub-assembly's characteristics may be determined according to the requirements derived from its purpose and the environmental conditions, from the automated assembly process requirements and from requirements of miscellaneous bodies such as ISO, FDA and the like. In the confining process, the flexible parts, the self-disintegrating parts and the uneven parts may be tightly coupled to one another and/or to some other solid component, while being anchored around the extremities. As a result of this confining process, an automated assembly process may be possible. The "confinement" may be either made consecutively or separately from the production and/or assembly stage. Implementing these confinement modifications and the changes to the structure of various components may improve the assembly process of the cartomizer. The assembly process allows for easy substitution and the flexibility of using different components as long as the different components are confined with similar characteristics and connectivity.

Other systems, methods, features and advantages will be, or will become, apparent to one with skill in the art upon examination of the following figures and detailed description. It is intended that all such additional systems, methods, features and advantages be included within this description, be within the scope of embodiments as disclosed herein, and be protected by the following claims. Nothing in this section should be taken as a limitation on those claims. Further aspects and advantages are discussed below.

Subject matter will now be described more fully hereinafter with reference to the accompanying drawings, which form a part hereof, and which show, by way of illustration, specific example embodiments. Subject matter may, however, be embodied in a variety of different forms, and therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware or any combination thereof (other than software per se). The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

FIG. 1 is a diagram of an electronic cigarette 100. The "smoke" produced by the electronic cigarette 100 is a created by turning a liquid (e-Liquid 110) into mist and some vapor with an aerosol generating component 112. The cartomizer 113 may include the aerosol generating component 112 and the e-Liquid 110 wherein the e-Liquid 110 is disposed in a storage space which can include a sponge which holds the e-Liquid 110. The cartomizer 113 may also be referred to as a cartridge throughout this disclosure and may be disposable. The e-Liquid 110 may have a high viscosity at room temperature to enable longer shelf life and reduce leakages; however, this high viscosity may reduce the vaporization rate. The e-Liquid 110 is vaporized via air flow 108 in an air space, generated by the inhalation of the user (i.e. the smoker or consumer or vapor), which produces a pressure difference that removes e-Liquid droplets from the e-Liquid 110. In order to reduce the e-Liquid viscosity, to a level enabling vaporization of the e-Liquid, external heat may be applied through a heating element 111. In one embodiment, the e-Liquid 110 may be soaked in a wick (not shown) which draws the e-Liquid from the storage space toward the heating element 111. In an embodiment, the heating element 111 may be a heater coil that wraps around the wick in order to heat the e-Liquid on the wick. In this embodiment, local viscosity reduction via heating, while inhalation occurs, enables e-Liquid vaporization in the inhalation-generated flow of air 108. The e-Liquid 110 may be heated via an electric current flowing through the heating element 111 and may then be vaporized and evaporated through the e-Cig and may contain tastes and aromas that create a smoking sensation. A controller 102 may be activated due to air flow 108 (from the inhaled air) passing a flow sensor 104. The sensor 104 may be activated by the pressure drop across the sensor and may directly switch a battery 106 power on, or be used as an input for the controller 102 that then switches the battery 106 current on. Although illustrated as separate from the e-Cig, the controller 102 may be a part of the e-Cig (e.g. along with the battery 106). The battery 106 may be a separate/removable assembly. The battery 106 may include one or more electronic chips controlling and communicating therewith. The battery 106 may connect with the cartomizer 113, which can be replaced or changed (e.g. when a new/different e-Liquid 110 is desired).

The e-Cig may include two parts. The first part is often just referred to as the battery or battery portion (i.e. battery enclosure) and it includes the battery 106, the air flow sensor 104 and the controller 102. The second part is the cartomizer 113 (i.e. cartridge) that is filled up with e-Liquid 110 and flavors that are required for smoke and flavor generation. The battery portion and the cartomizer may be connected by metal connectors. An airflow tube of the battery enclosure and an airflow tube of the cartomizer may enable the smoker to puff through the electronic cigarette and activate the airflow sensor 104 inside the battery portion. This may trigger the controller 102 and thereby cause the heating element (i.e. a heater coil) 111 inside the cartomizer to get hot, evaporate the e-Liquid that is in the cartomizer and form vapor. Although not shown in FIG. 1, the e-Cig may include connections (i.e. connectors or electrical connections) that are used for power delivery from the battery 106 to the heating element 111 and for charging the battery 106.

Figure 2:
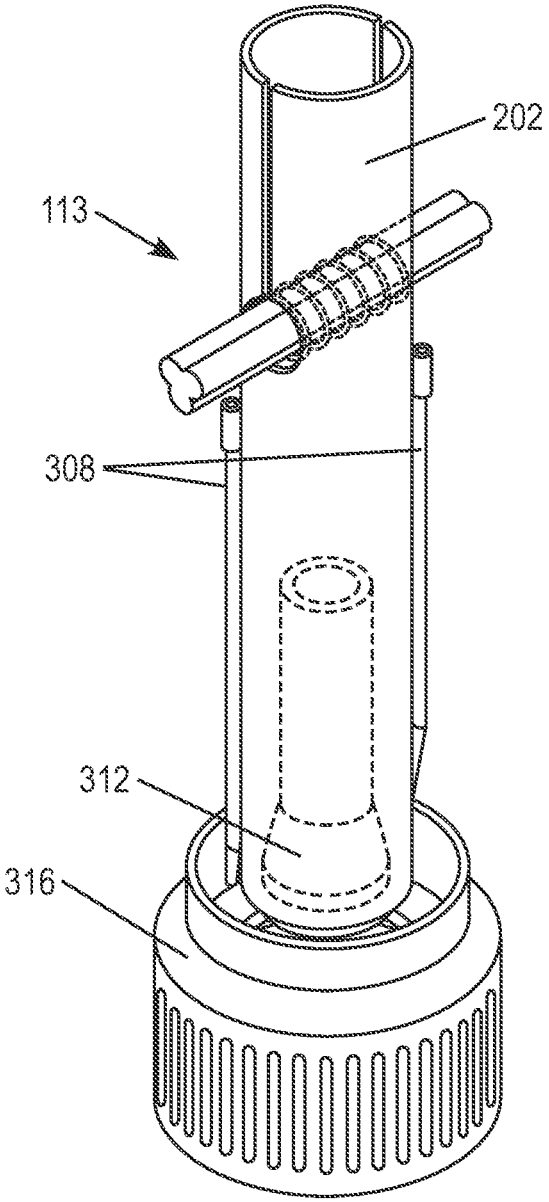
FIG. 2 is a diagram of the structure of a cartomizer in an electronic cigarette.

FIG. 2 is a diagram of the structure of a manually assembled cartomizer 113 of an electronic cigarette. FIG. 2 illustrates metal parts including a post 312 and thread 316, exposed conductive wires 308 which are arranged to be in the e-Liquid storage space of the electronic cigarette, and a flexible fiberglass sleeve 202 of the cartomizer 113. The cartomizer 113 as illustrated in FIG. 2 may be manually assembled.

Figure 3:
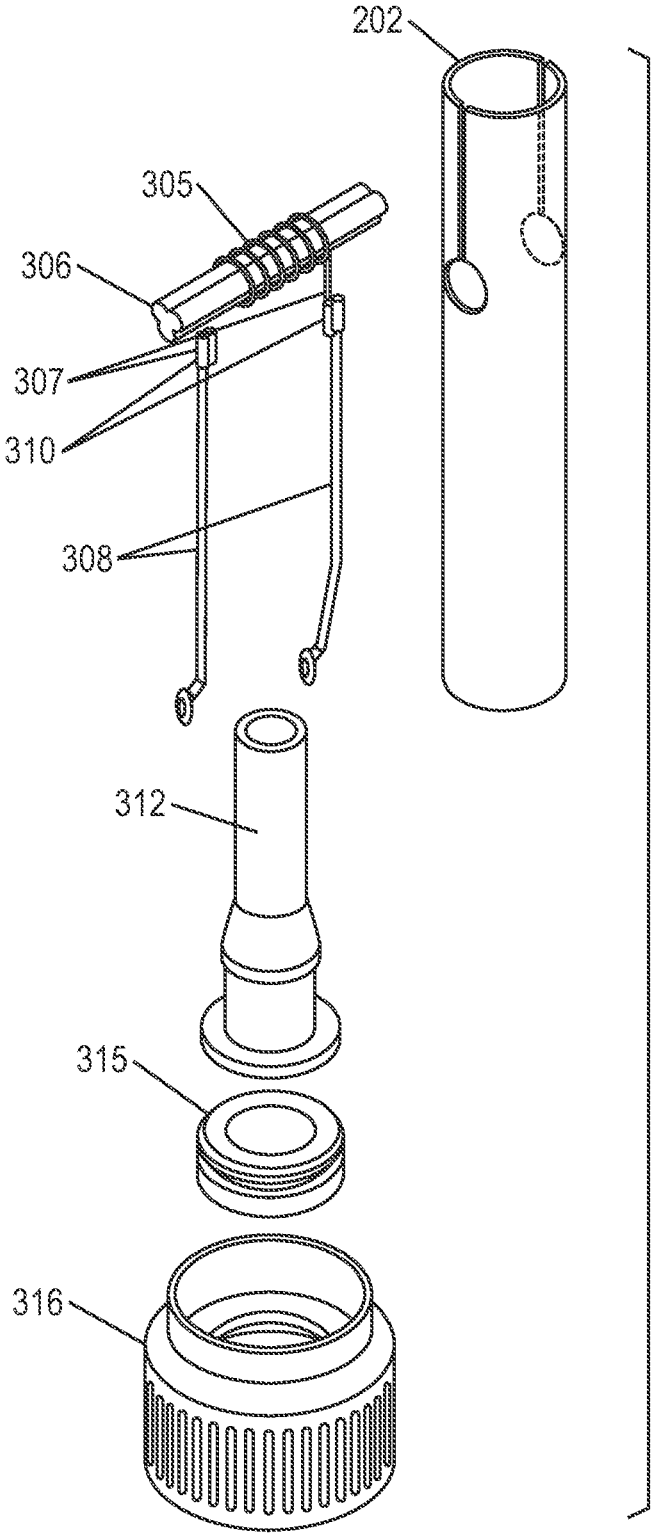
FIG. 3 is a diagram of the parts of a cartomizer in an electronic cigarette.

FIG. 3 is a diagram of parts of a cartomizer 113 of an electronic cigarette. FIG. 3 illustrates parts (i.e. components) from the cartomizer 113 as shown in FIG. 2. In the manually assembled cartomizer 113, a heater coil 305 is wound around the wick 306. Later in the assembly process, leads 307 of the heater coil 305 are connected to the conducting wires 308 by external crimps 310, and each of the other ends of the conducting wires 308 can be connected by various methods to the metal parts such as the post 312 and the thread 316. As used herein, the term "metal parts" refers to at least a first and a second conductive bodies which are arranged to electrically connect respective poles of the battery of the electronic cigarette with one of the respective conducting wires 308 such that the battery is in electrical contact with the heater coil 305 and wherein the metal parts form part of the structure of the cartomizer 113 as well as an e-Liquid seal which confines e-Liquid 110 in the storage space of the cartomizer 113.

In some products, connecting the conducting wires 308 to the post 312 and/or the thread 316 is based on inserting the tips of the conducting wires 308 (the ends of each the conducting wires which are not connected to the heater coil 305) to a respective one of the metal parts such as the post 312 and the thread 316 wherein an insulating ring 315 electrically isolates the post 312 from the thread 316 such that an electrical circuit can be formed between the cartomizer 113 and the battery portion. In an embodiment, the connection of the conducting wires 308 to the leads 307 of the heater coil 305 may be forgone wherein the leads 307 of the heater coil 305 are connected to the metal parts (i.e. the respective post 312 and thread 316) at contact points thereof (as used herein contact points). In this embodiment, the seals of the cartomizer 113 should not be compromised, and further there is a possibility of heat buildup in the heater coil 305 starting at contact points wherein one of the leads 307 contacts the post 312 or the thread 316. In an embodiment, the heater coil 305 may need to be in close proximity to the contact points, instead of the mid-section of the cartomizer 113 so as to enable optimal utilization of the e-Liquid 110.

The connection of the heater coil 305 to the contacts points and the location processes which position the heater 305 in the fiberglass tube 202 may involve the insertion of the wick 306 and heater coil 305 into the fiberglass tube 202, or conversely placing the fiberglass tube 202 around a wick-coil assembly 306/305 formed from the wick 306 and heater coil 305. During the placement of the wick-coil assembly 306/305 in the fiberglass tube 202 distortions and misplacements between the heater coil 305 and wick 306 or between the wick-coil assembly 306/305 and the fiberglass tube 202 can occur. Further, if part of the heater coil 305 were to touch the sponge (not shown), which holds the e-Liquid 110, it may cause burning of the sponge during heating of the heater coil 305. As such, the elasticity requirements for assembly purposes of the cartomizer 113 thus meant that the conducting wires 308 were located within the storage space occupied by the e-Liquid 110 and optionally the sponge, rather than the airflow space 108 (see FIG. 1), with all the consequences of the e-Liquid's effect on the conductors 308 and vice-versa, as far as materials composition and component temperature are concerned.

Figure 4:
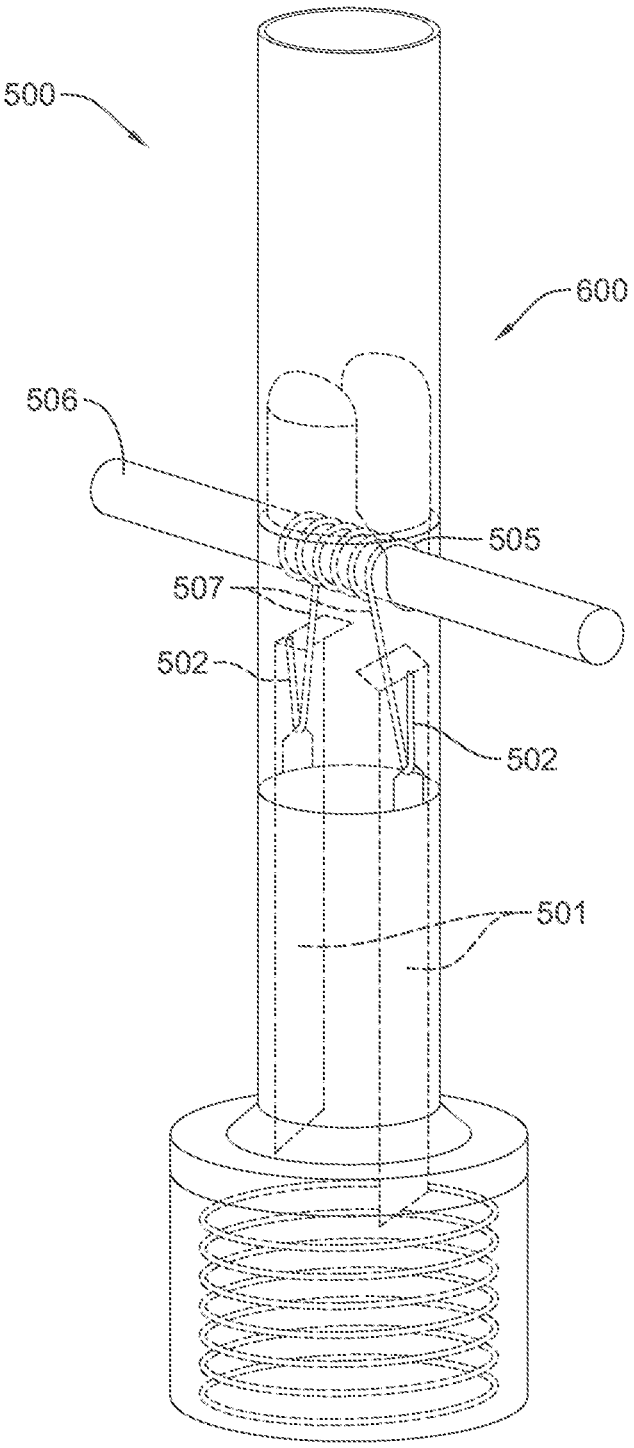
FIG. 4 is diagram of a cartomizer structure with automation compatible parts.
Figure 5:
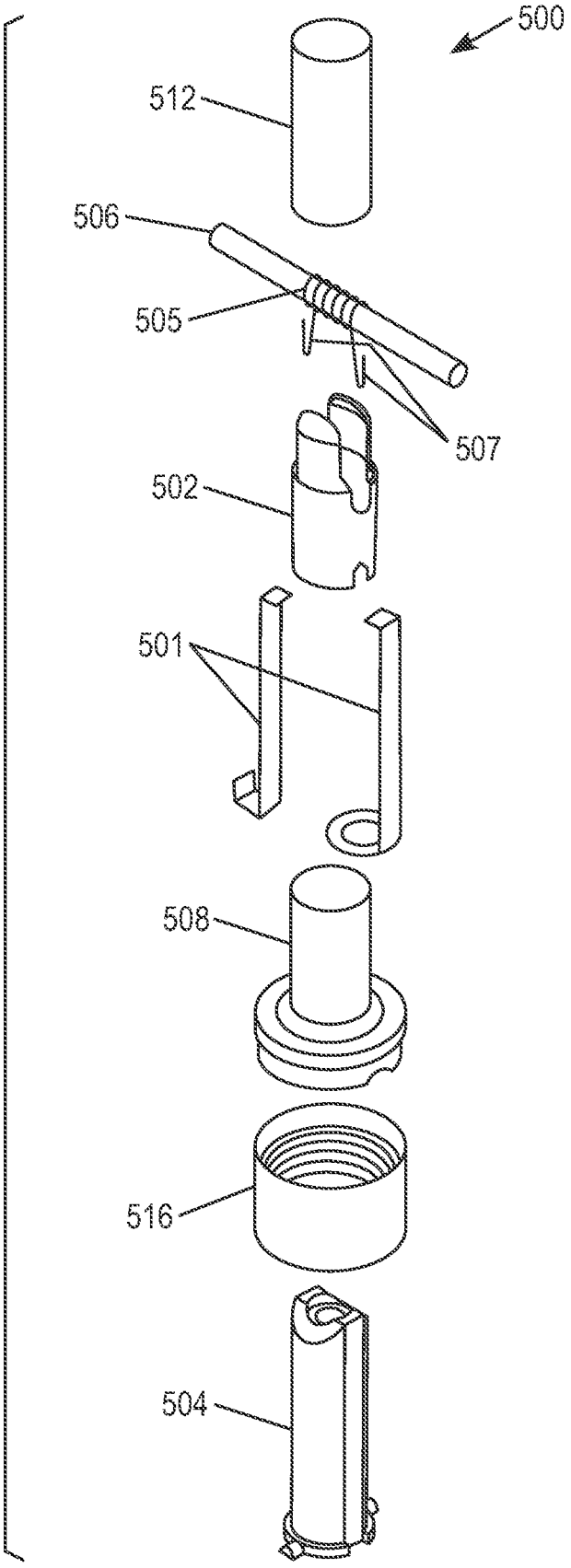
FIG. 5 is diagram of automation compatible parts in a cartomizer.

FIG. 4 is diagram of a cartomizer assembly 500 which has parts that are automation compatible. FIG. 5 illustrates the parts of the cartomizer assembly 500 as shown in FIG. 4 wherein the parts are automation compatible. As illustrated in FIGS. 4 and 5, there are electrical conductors 501 (as used herein conductors) built as conductive strips and/or wires connected on one side to the battery leads (not shown). The other sides of the conductors 501 are supported by a container 502 that contains a wick 506 and a heater coil 505 to form a container assembly 600. Preferably, the container 502 can support the conductors 501 when the container 502 is put (e.g. snapped) into place in the cartomizer assembly 500, such as by putting the container on an inner post 504 of the of the cartomizer assembly 500. By snapping the container 502 into place the required mechanical fixation of the conductors 501 is created wherein the mechanical fixation of the conductors 501 also results in contact between the heater coil leads 507 and the conductors 501. This eliminates the need for crimp connections, laser welding or any other external welding method, and therefore simplifies manufacturing processes of the cartomizer assembly 500. Contact pressure between the heater coil leads 507 and the conductors 501 can be created by the container 502 such that sufficient contact between any diameters of wire of the heater coil leads 507 to any size of the conductor 501 and between all types of materials thereof can be achieved. This structure, with changes between sealing and electrical conduction, thereby enables changes to the metallic raw material in some of the components of the cartomizer assembly 500 that may be replaced with plastic raw material.

The assembly method is based on the knowledge of the location and orientation of the wick 506 and the heater coil 505 forming a wick-coil assembly 506/505 (as used herein a "set") when exiting a winding machine that forms the sets. After a set exits the winding machine and after the sets disconnection from the other sets formed by the winding machine, a process is executed by which a mechanical clamp grabs the set and feeds it into the container 502. In machines in which the wick cutting occurs before winding the heater coil therearound, the stage of grabbing the product as a set may occur after the winding and the cutting of the wire are completed.

As shown in FIG. 5, the cartomizer assembly 500 can also include a sleeve 512, such as a fiber glass sleeve, disposed above the container 502. The cartomizer assembly 500 can also include an inner post 504, thread 516, and an outer post 508 disposed below the container 502.

Figure 6:
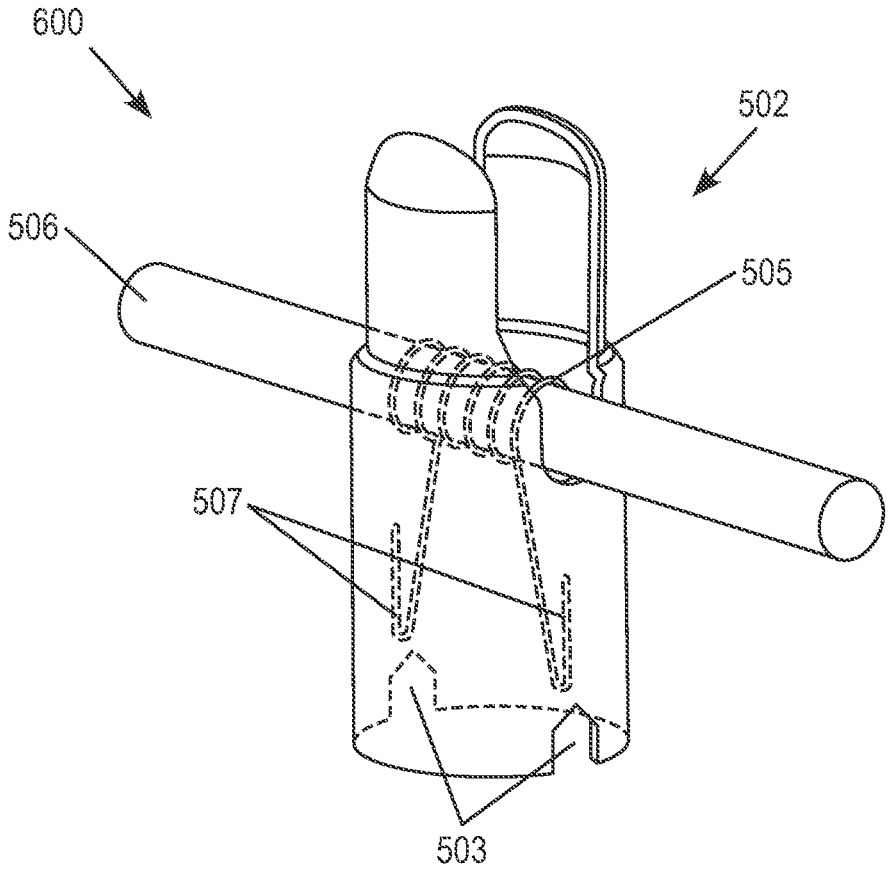
FIG. 6 is a diagram of a container for the heater coil and wick.

FIG. 6 is a diagram of a container 502 for the heater coil 505 and wick 506 which forms a container assembly 600. In particular, FIG. 6 illustrates the way the wick 506 and the heater coil 505 are located in the container 502, and the heater coil tips (i.e. heater coil leads 507) that are held in the location notches 503 of the container 502, in a way that allows the automatic assembly process to be performed. In this structure the entire heater coil 505 is confined inside the container 502 wherein the heater coil 505 surrounds the wick 506 such that there is no possibility of the heater coil 505 coming into contact with a sponge that is located outside the container 502. Later in the process the heater coil tips (i.e. heater coil leads 507) are placed into designated grooves (i.e. the location notches 503) in container 502 and bent outwards, both for positioning purposes as specified and to prevent the wire of the heater coil from changing position during assembly thereof such that the heater coil 505 and wick 506 remain in place in the container 502. In this embodiment, the position of the conductors 501 may be isolated either from the airflow space or the e-Liquid soaked in the sponge in the storage space as previous constraints dictated, and therefore, by isolating the conductors 501 harmful and unwanted mutual effects caused by positioning the conductors 501 in the airflow space or the storage space can be prevented.

Figure 7:
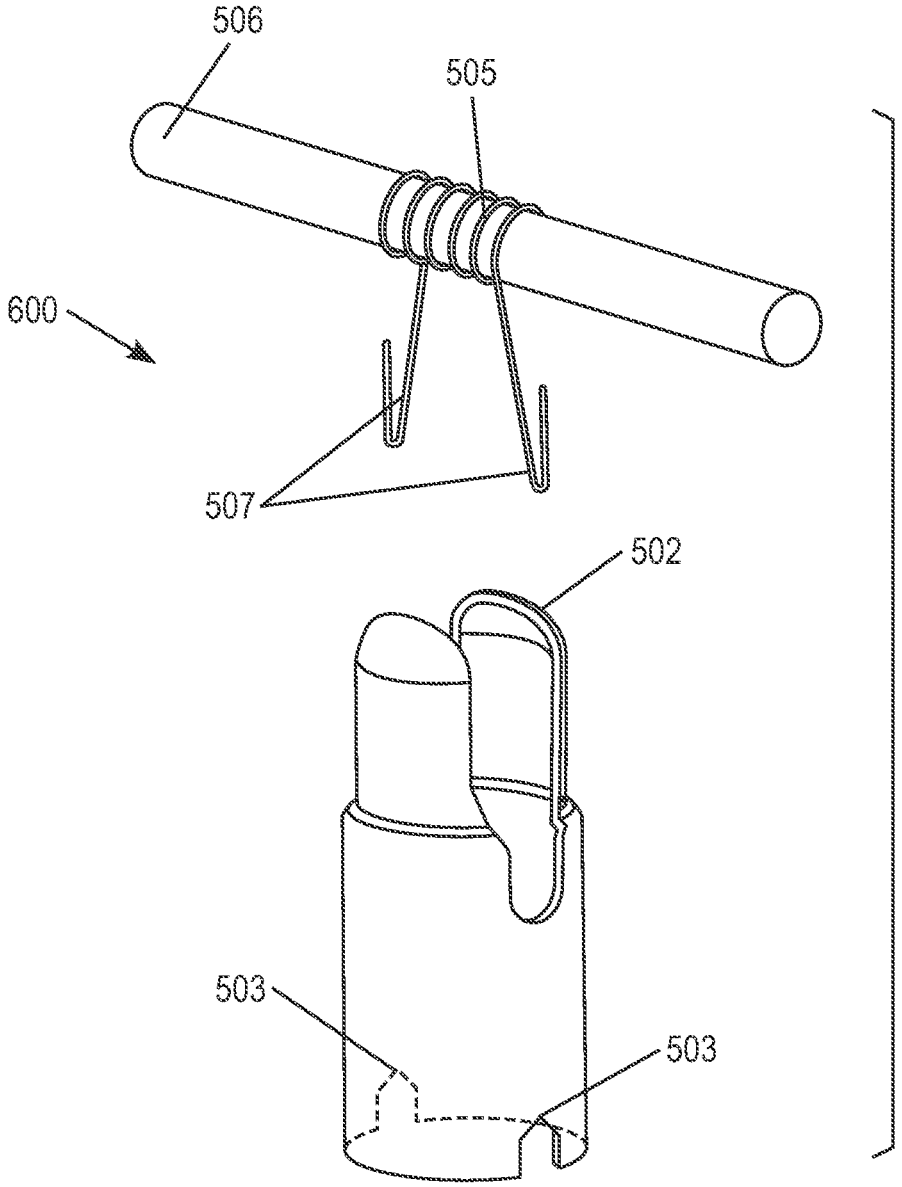
FIG. 7 is a diagram of the assembly of a container for the heater coil and wick.

FIG. 7 is a diagram of the container assembly 600 formed of a container 502, the heater coil 505 and wick 506 wherein the container contains the heater coil 505 and wick 506. In particular, FIG. 7 illustrates the container 502 before an assembly process for the cartomizer assembly shown in FIG. 6 has been performed and further illustrates the location of the heater coil 505 in the container 502. The container 502 may be designed according to requirements that stem from its role and its use as well as according to requirements and guidelines originating from standardization and regulatory organizations (e.g. the Food and Drug Administration). The container 502 may be resistant to temperatures as high as those that occur in the close environment of the heater coil 505 and to their regimens, and it will have the mechanical robustness required to apply the contact pressure needed to electrically connect the heater coil leads 507 with the conductors (not shown), and will feature sufficient heat conductivity combined with low thermal mass so as to enable appropriate heat dissipation from the heater coil 505 to the areas where the wick 506 enters the airflow space to enable heating the e-Liquid soaked sponge and reduce the viscosity of the E-liquid in order to improve flow in the wick 506. In one embodiment, the temperature in the heater coil 505 may be up to 600° C. while in the area of the container 502; about 250° C. may be expected. If temperature control is applied, then the temperatures may be lower. There may be electrical isolation between the container 502, the case of the electronic cigarette, the heater coil leads 507, and other components of the cartomizer assembly or electronic cigarette. In one embodiment, the container 502 may be anodized aluminum or another metal that is suited to surface treatment with similar characteristics. In another embodiment the surface treatment may be incomplete or partial but the electrical isolation must be kept in places where at least one heater coil lead 507 and a respective conductor 501 are touching to prevent a shortcut for the electrical current supplied therethrough. The shape of the container 502 may enable the set that is inserted or released into it to settle in an optimal fashion at the center of the container without warping and also to place the heater coil leads 507 in a place and orientation that will lead to optimal tightening to the conductors 501. Preferably the container 502 is tubular shaped.

The design of the conductors 501 by structure and material is used not only for conducting the electrical current into the heater coil 505, but also for conducting and thereby removing the excess heat that develops in the heater coil 505, (excess because of the position of the conductors at the edges of the heater coil leads 507 that heat up only after heating the center of the heater coil 505) toward the larger metal parts of the battery leads outside the cartomizer assembly. Some of the heat that develops in the heater coil 505 is conducted by the container 502 toward the sponge and e-Liquid surrounding it which can cause a decrease in e-Liquid viscosity and improve the e-Liquid flow within the wick, and thus improve the smoking experience.

Figure 8:
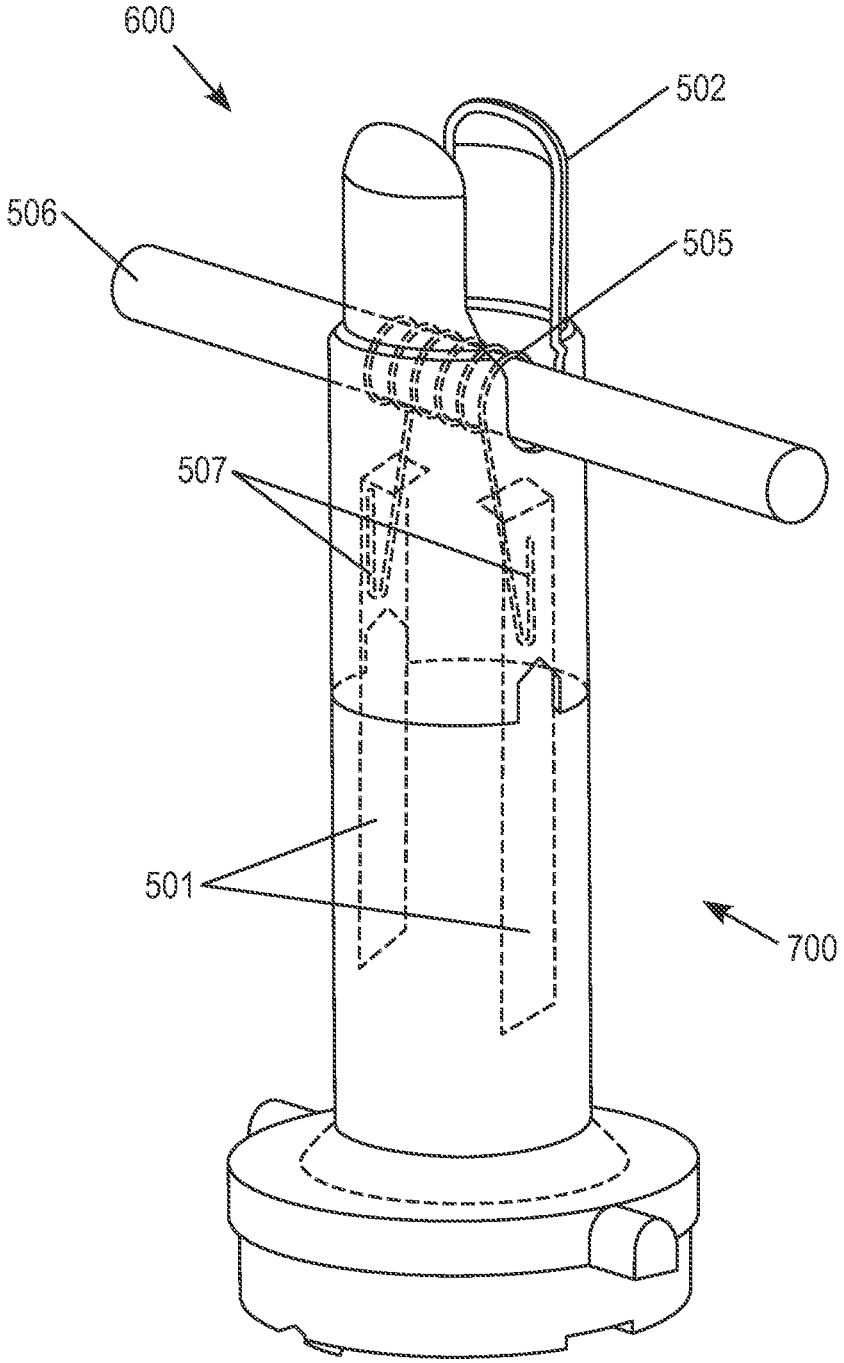
FIG. 8 is a diagram of the heater coil assembly.

FIG. 8 is a diagram of the container assembly 600 included on a post assembly 700 of the cartomizer assembly. In particular, FIG. 8 illustrates the way the heater coil leads 507 are pressed against the conductors 501. This structure may eliminate a need for crimping or soldering the heater coil leads 507 to the respective conductors 501. The design change and the container 502 enable the connection of a rigid tube in the airway, which improves the quality of the sealed airway between the e-Liquid and also allows the use of a material with a good thermal conductivity within the hot air route which contains generated mist. This results in thermal energy dissipation toward the contact area between the e-Liquid/sponge and the tube. This contributes to the cooling of the tube together with the reduction in e-Liquid viscosity at the contact area that will lead to improved e-Liquid flow to the wick area.

The method for the insertion of a conductor 501 allows the use of more efficient, commercially available materials and production methods, and opens up possibilities for automating the assembly process as well as upgrading it into a "green" process in terms of material and energy resources necessary for assembly. Simplification and flexibility in the assembly process tabs have been added to several parts as shown in FIGS. 7-8 whose function is to allow the placement of parts in the required orientation by simple means of slants on the sides that lead to the product to the necessary position and orientation. One may also use the tabs that are created at the point of entry of the material product notch in the injection molds for the same purpose.

Figure 9:
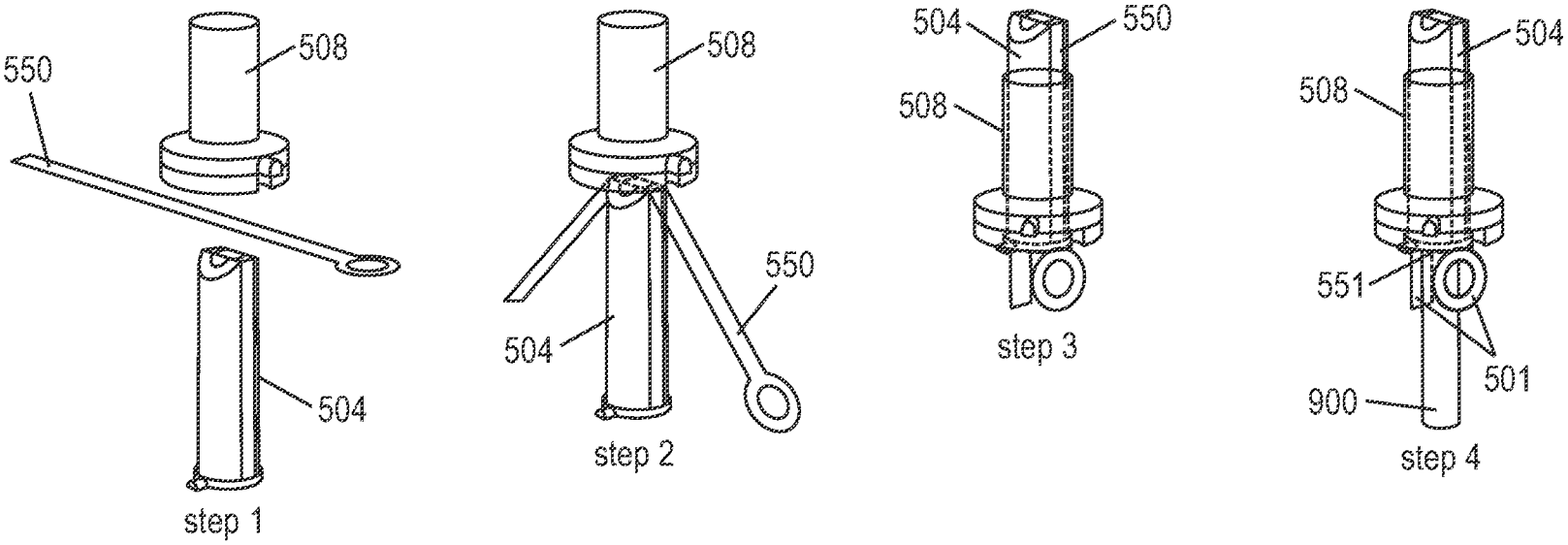
FIG. 9 is a diagram of the conductive element assembly process.

FIG. 9 is a diagram of an assembly process of forming conductors 501 which are disposed in the inner and outer posts 504, 508. In particular, FIG. 9 illustrates the steps in which the conductors 501 are formed. During the assembly process, a conductive strip 550, such as a metal strip, is fed as a straight strip between an inner post 504 and an outer post 508. The inner post 504 is inserted into the outer post 508 which locks the conductive strip 550 in place. In an embodiment the inner post 504 and the outer post 508 can be cylindrical wherein the inner post 504 fits in the outer post 508. A punch 900 is inserted through a hole 551 in the inner post 504 after the conductive strip 550 is locked in place such that the conductive strip 550 is cut in the middle into two separate conductors 501. The conductive strip 550 may be soft so that the punch 900 can be inserted easily to form the conductors 501.

In the process of inserting the inner post 504 into the outer post 508 the conductive strip 550 used to form the conductors 501 is added therebetween, so that the act of inserting the inner post 504 into the outer post 508 positions the conductive strip 550 or conductors 501 in place while obtaining a seal that fixes the conductors 501 in place. The conductive strip 550 can be fed as a connected strip wherein the separation thereof into two sections to form the conductors 501 is performed after the completion of insertion process. Alternatively, the conductors 501 can be fed in the insertion process as two separate units. The utilization of conductors 501 with large surface area and volume enables the heat conduction from the heater coil 505 to the outside. The inner post's 504 resilience to heat that develops at the heater coil 505 can be improved by creating gradients and moving margins that are not essential for proper functioning of the electronic cigarette away from the heat. Further improvement may be achieved by masking the part by the electrical conductors 501 that block and conduct the heat in order to disperse it away towards the relatively high thermal mass thereof in comparison with the heater coil 505. Since e-Cig smoking is not continuous, the temperature within the conductors 501 and other parts of the e-Cig does not significantly rise.

Figure 10:
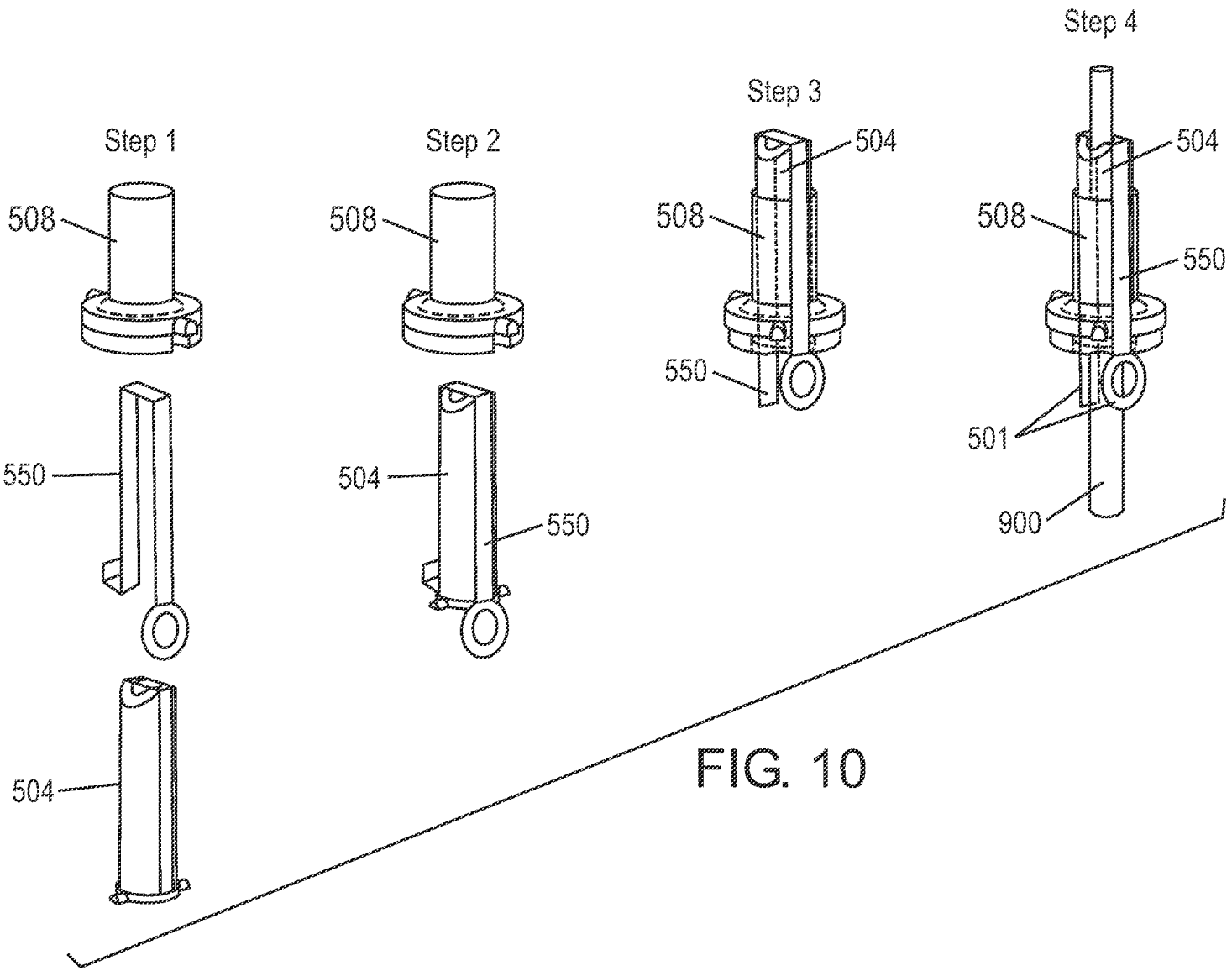
FIG. 10 is a diagram of the assembly process for the posts.

FIG. 10 is a diagram of the assembly process for the inner and outer posts 504, 508. In particular, FIG. 10 illustrates exemplary steps to assemble the inner post 504 into the outer post 508 with a harder metal conductive strip 550 than was shown in FIG. 9. When the hardness of the inner post 504 or outer post 508 is decreased below that of the metal conductive strip 550, there may be bending of the metal conductive strip 550 before insertion between the inner and outer posts 504, 508. The operation as illustrated in step four may be similar to that illustrated in FIG. 9 in order to cut the metal conductive strip 550 into two separate conductors 501.

Figure 11:
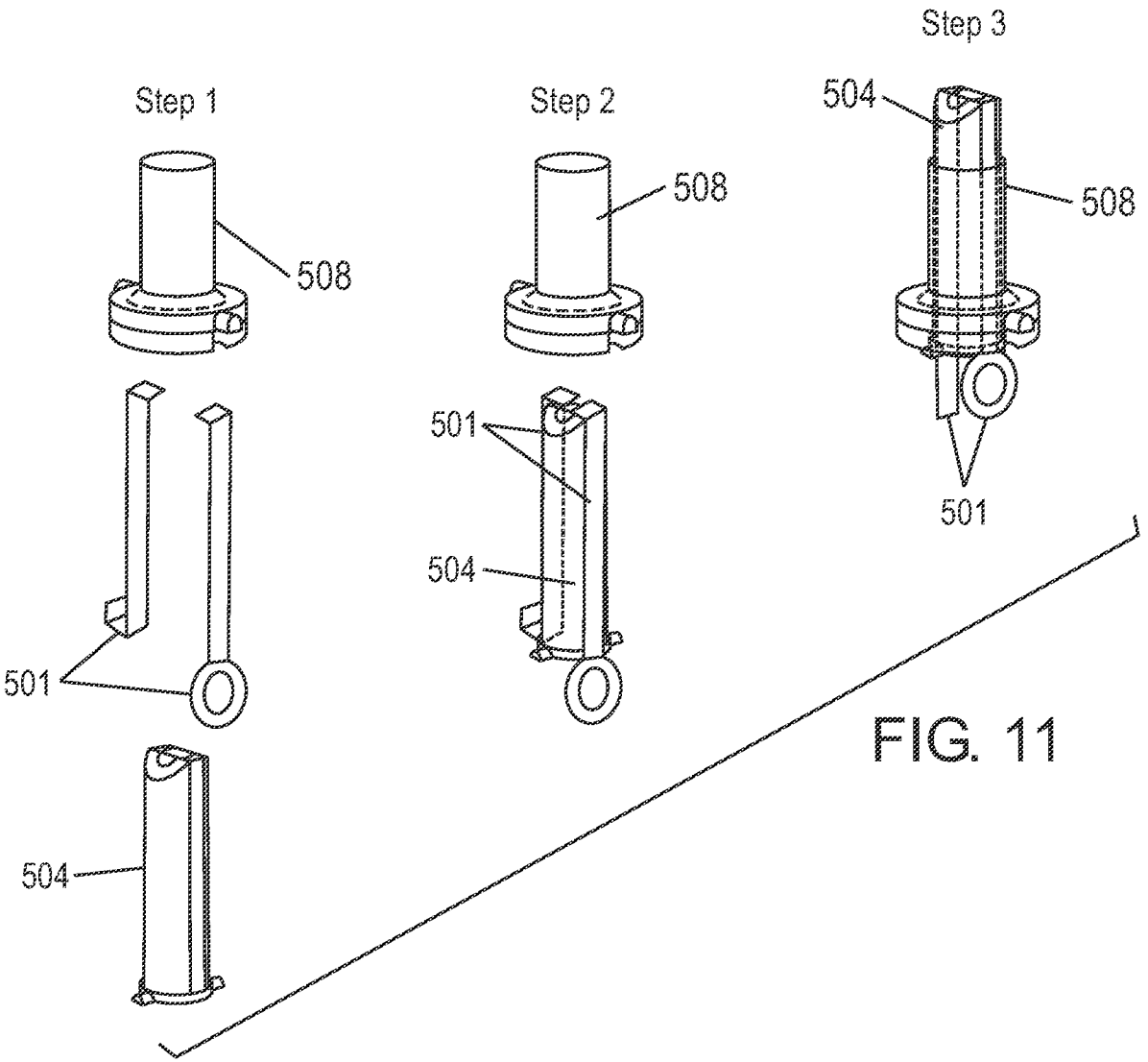
FIG. 11 is a diagram of the assembly process for the posts using multiple conductors.

FIG. 11 is a diagram of the assembly process for the inner and outer posts 504, 508 wherein conductors 501 are utilized in the assembly process. In particular, FIG. 11 illustrates the assembly operation with two separate conductors 501 instead of a single conductive strip. Although the feeding stage of the conductors 501 may be more difficult, the cutting step becomes unnecessary.

Figure 12:
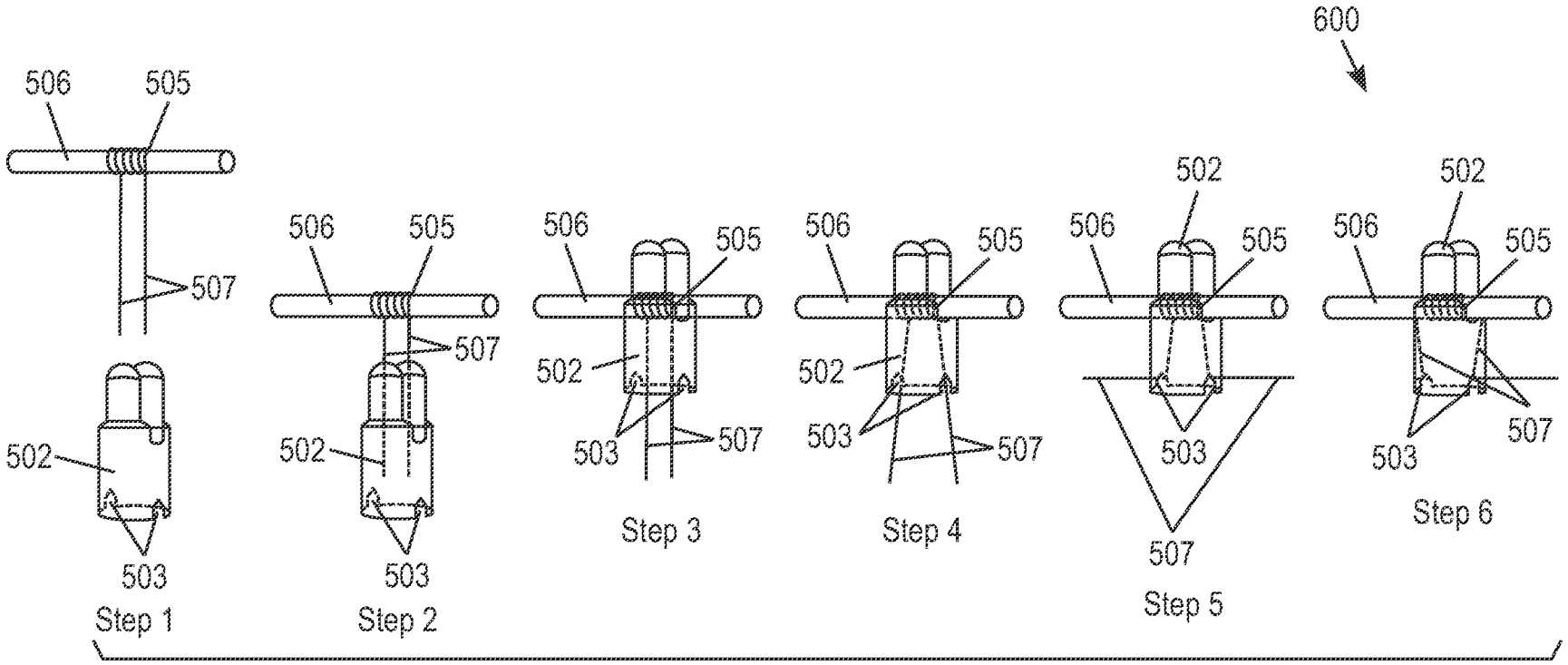
FIG. 12 is a diagram of the assembly process for the container, heater coil, and wick.

FIG. 12 is a diagram of the assembly process for a container assembly 600 including container 502, wick 506 and heater 505. In particular, FIG. 12 illustrates exemplary steps for assembly of the container 502 shown in FIG. 7. The wick 506 and heater coil 505 can be dropped into the container 502 such that they are located and directed to position based on the shapes of the heater coil 505, wick 506, and container 502 (see step 1). The heater coil leads are inserted into the container 502 when the wick 506 and heater coil 505 are dropped into the container 502 (see step 2). As shown in step 3, the wick 506 and the heater coil 505 are in the container 502 at the desired location, but the heater coil leads 507 may be at an incorrect location. In step four, the heater coil leads 507 are moved to the proper location based on the location notches 503. In step five, the wick 506 and heater coil 505 are anchored by the heater coil leads 507 in order to assure quality contact. In step six, the heater coil leads 507 are bent in order to improve the location, and prevent movements during the next assembly step of pressing the container 502 on the conductors 501 and the inner post 504 as shown in FIG. 8.

Figure 13B:
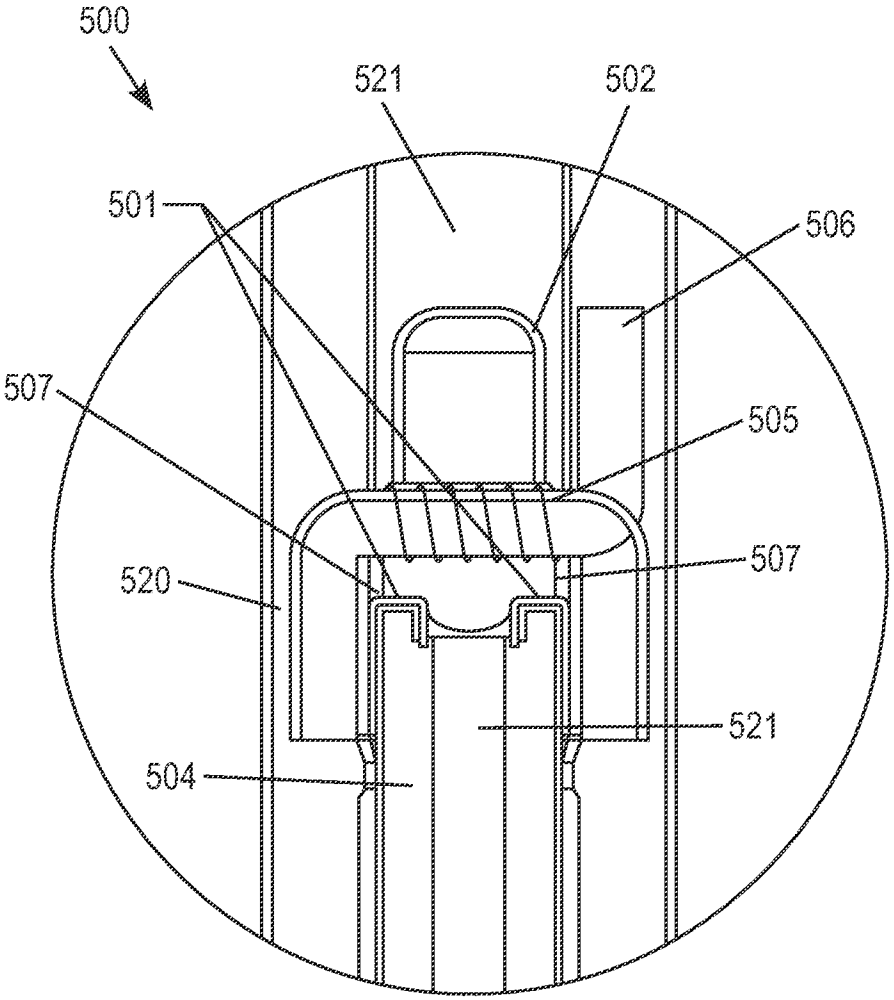
FIG. 13A is a diagram of the spacing of the container and FIG. 13B is an exploded diagram of the spacing of the container.
Figure 13A:
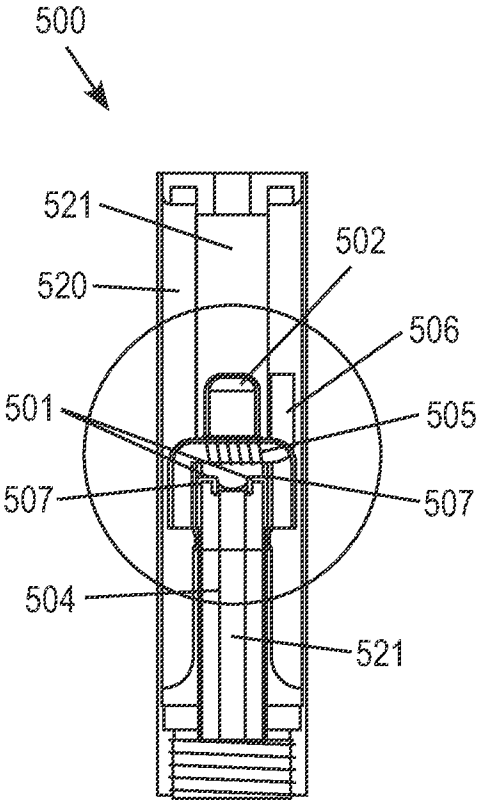

FIG. 13A is a diagram of the spacing of the container 502 in the cartomizer assembly 500 and FIG. 13B is an exploded view of the spacing of the container 502 in the cartomizer assembly 500. In particular, FIGS. 13A and 13B illustrate the advantages of the cartomizer assembly 500 by isolating the conductors 501 from an e-Liquid container (i.e. liquid storage space) 520 while also minimizing exposure to the air flow in an air space 521, and shielding the front area of the inner post 504 from exposure to heat generated by the heater coil 505. The electric current flow from leads of the battery takes place directly through the conductors 501 which form failure-prone connections with the heater coil leads 507 and therefore eliminates the need to produce the carrier and sealing parts from expensive and superfluous metal, but rather from plastic materials.

The location of the conductors 501 is not in the e-Liquid in the e-Liquid container 520 and therefore they are not subject to the mutual effect on/from the e-Liquid. The location may not be entirely in the air space 521 either so that its mutual effect on/from the aerosol mist is minimal. The design of the conductors 501 with a ring on one pole and/or two rings to both poles of the battery allows using batteries in which the surface of the poles are not uniform and smooth, but rather, notched for various reasons such as to accommodate side vents. In places where notches are needed, the elastic properties of the conductors 501 may be improved by changing their shape and/or adding a tab whose physical structure allows it to be springy and/or creating a double wall, triple wall or more in order to obtain condensation at the necessary places and applications.

Figure 14:
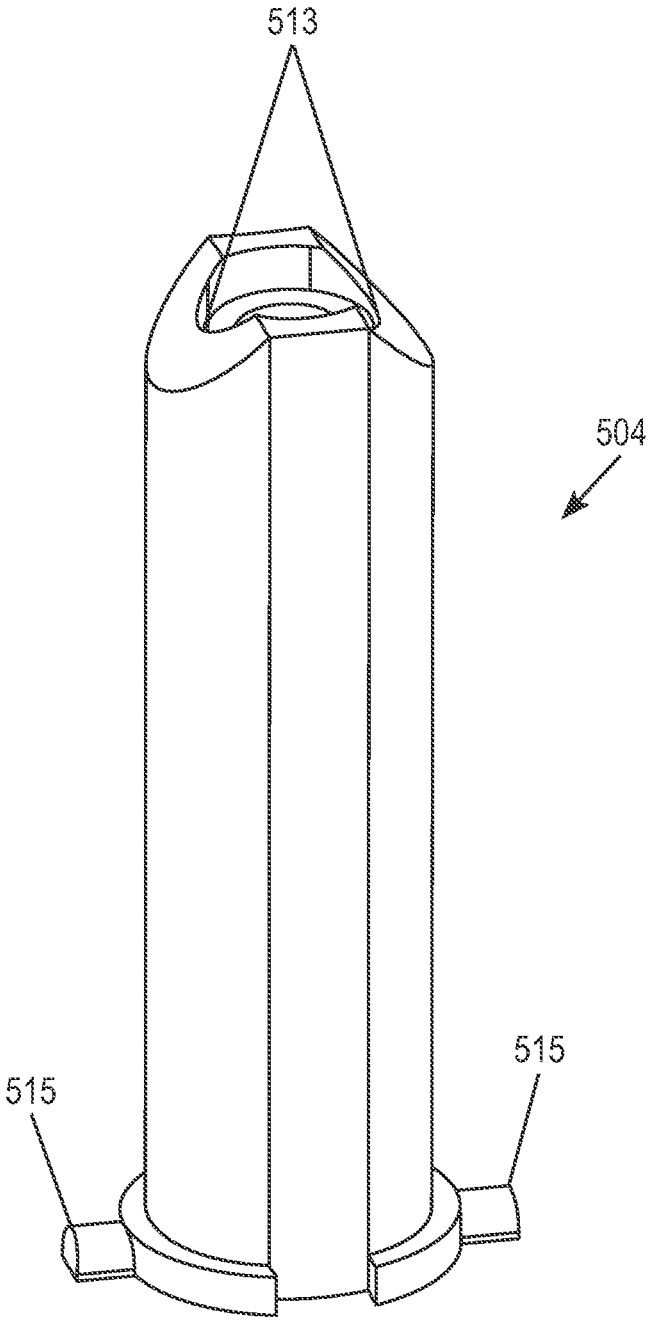
FIG. 14 is a diagram of chamfers of the inner post.
Figure 15:
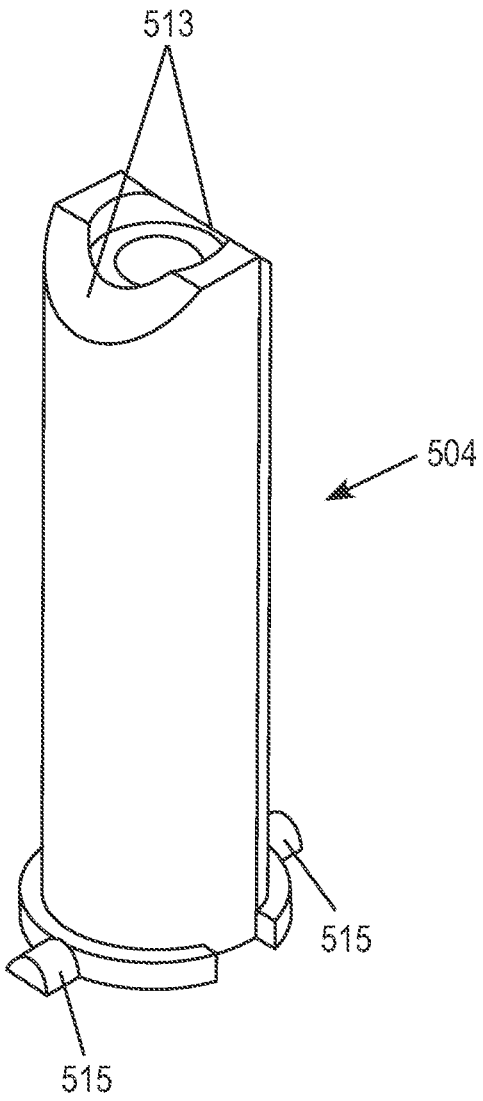
FIG. 15 is a diagram of an alternative view of chamfers in the inner post.

FIG. 14 is a diagram of the chamfers 513 of the inner post 504 at the front of the inner post 504 that is configured to be located near the heater coil (not shown). FIG. 15 is a diagram of an alternative view of the chamfers 513 of the inner post 504. The front side exposure of the chamfers 513 to heat from the heater coil is lowered in this design. Further, "orientation fingers" 515 of the inner post 504 may streamline the assembly process by creating a simple way to locate the inner post 504 in the desired place and orientation such as in the outer post 508. The chamfers 513 may be a notch in the inner post 504. The chamfers 513 on the side close to the heater coil are made to increase the distance from the heater coil and reduce the surface temperature. Because of its location near the heater coil, the inner post 504 may be used to contain any object that can improve the cartomizer assembly's operation, such as a temperature tester, or any other electronic equipment.

Figure 16:
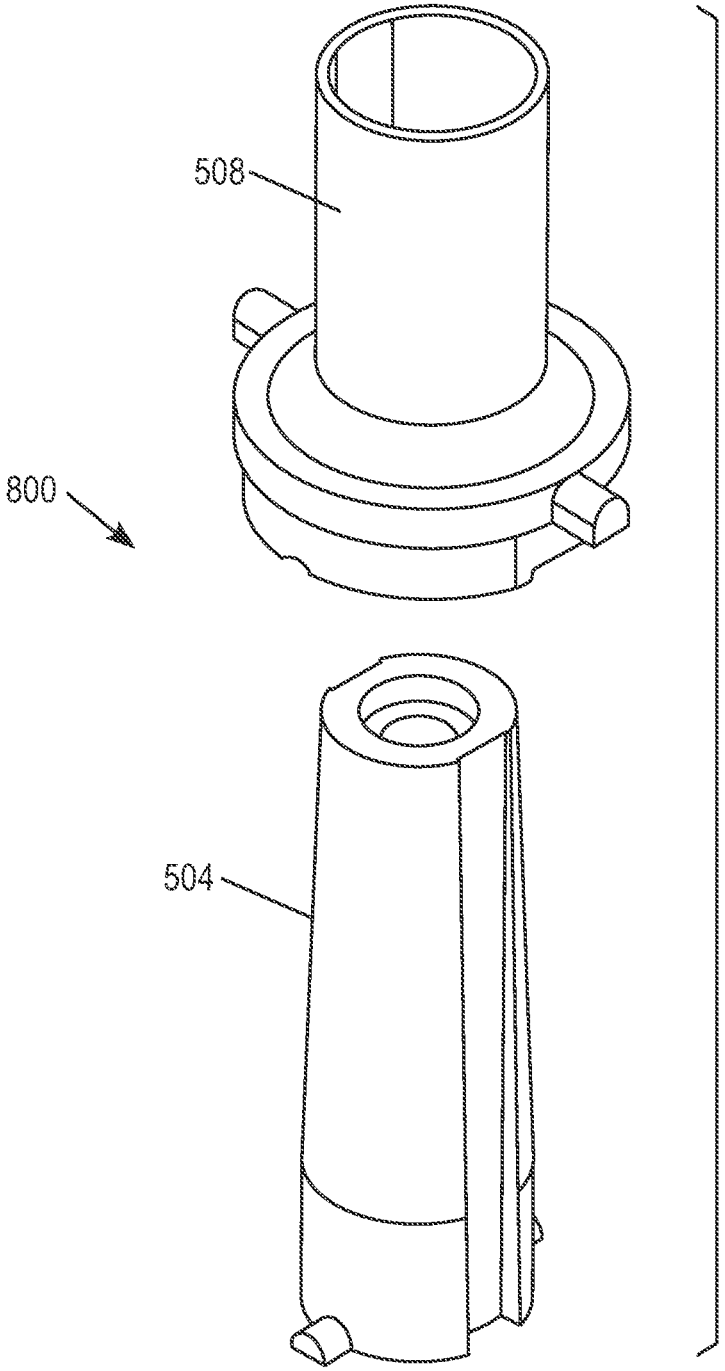
FIG. 16 is a diagram of the inner and the outer posts with matching cone shaped portions.

FIG. 16 is a diagram of the inner post 504 which is cone shaped (conical). The outer post 508 may have a matching cone therein for locking with the cone shaped inner post 504. The locking may thus occur with less power or pressure. The cone shapes of the inner and outer posts 504, 508 can be along the entire length or part of the length of the inner and outer posts 504, 508 while the rest of the inner and outer posts 504, 508 are parallel.

Figure 17:
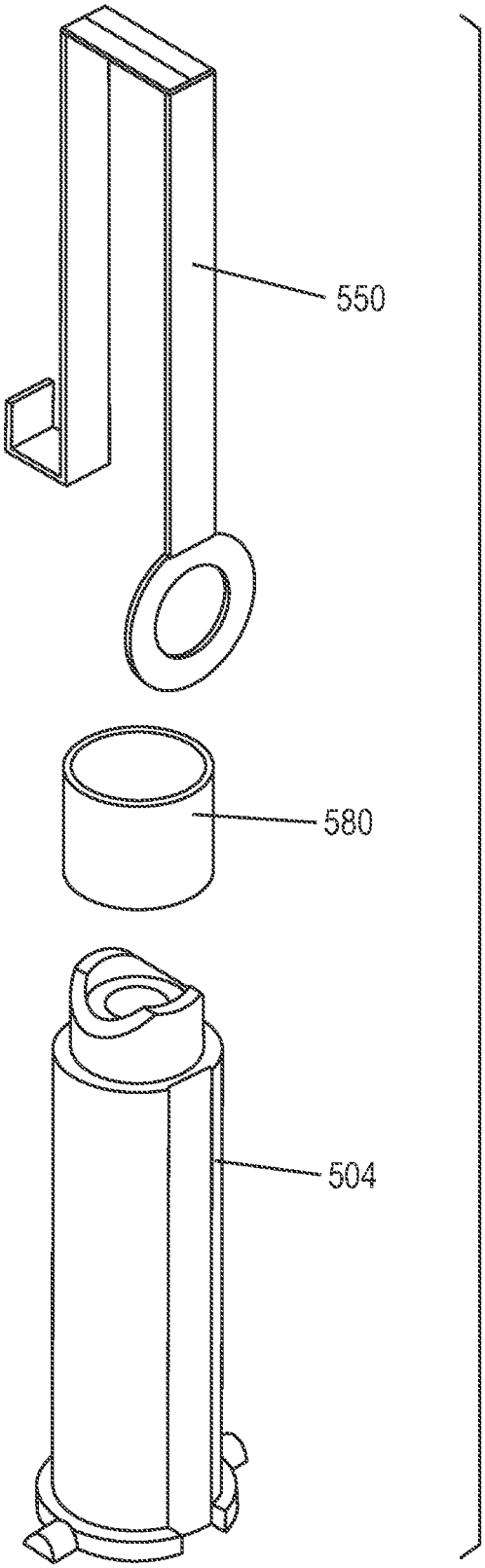
FIG. 17 is a diagram of an isolated tube with an inner post.

FIG. 17 is a diagram of an isolated tube 580 included with an inner post 504. In particular, FIG. 17 shows an optional isolated tube 580 disposed under the conductive strip 550, which is used to form the conductors 501, for support above the inner post 504. The optional isolated tube 580 may be located between the conductive strip 550 and the inner post 504 upper surface, while electrical contact is still maintained between the conductors 501 and the heater coil leads (not shown) after the conductors 501 have been formed from the conductive strip 550.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

We claim:

1. A method of assembling a cartomizer assembly of an electronic cigarette wherein the cartomizer assembly is formed from automated assembly compatible parts, the method comprising:

inserting an inner post into an outer post wherein a conductive strip is disposed therebetween; and inserting a punch into a hole in the inner post wherein the punch removes a portion of the conductive strip so as to form conductors.

2. The method of claim 1, comprising aligning orientation fingers of the inner post into the outer post.

3. The method of claim 1, further comprising:

forming a container assembly, the container assembly formed by winding a heater coil around a wick, dropping the heater coil and wick into a container, and locating heater coil leads of the heater coil in location notches of the container by bending ends of the heater coil leads around an end of the container; and putting the container assembly on the inner post wherein each heater coil lead electrically connects with a respective conductor.

4. The method of claim 3, further comprising disposing the container assembly, the inner post, and the outer post in a liquid storage area of a cartomizer assembly such that the wick is in liquid communication with liquid in the liquid storage area and the conductors are isolated from the liquid storage area.

* * * * *